United States Patent [19]

Geringer et al.

[11] Patent Number: 5,006,723

[45] Date of Patent: Apr. 9, 1991

[54] ELECTROMAGNETIC DOOR LOCK DEVICE

[76] Inventors: Arthur Geringer, 5029 E. Jacobs Ct., Agoura, Calif. 91301; Richard Geringer, 2663 Riata Ct., Camarillo, Calif. 93010; David Geringer, 28364 Balkin, Agoura, Calif. 91301

[21] Appl. No.: 516,657

[22] Filed: Apr. 30, 1990

[51] Int. Cl.[5] ..... E05C 17/56

[52] U.S. Cl. ..... 292/251.5; 292/144

[58] Field of Search ..... 292/251.5, 144, DIG. 15, 292/302, 74, 92

[56] References Cited

U.S. PATENT DOCUMENTS

| | | | |
|---|---|---|---|
| 4,306,744 | 12/1981 | Krehbiel | 292/144 |
| 4,439,808 | 3/1984 | Gillham | 292/144 |
| 4,487,439 | 12/1984 | McFadden | 292/251.5 |
| 4,652,028 | 3/1987 | Logan et al. | 292/251.5 |
| 4,826,223 | 5/1989 | Geringer et al. | 292/251.5 |
| 4,840,411 | 6/1989 | Sowersby | 292/144 |
| 4,861,080 | 8/1989 | Frolov | 292/251.5 |

*Primary Examiner*—Eric K. Nicholson
*Attorney, Agent, or Firm*—John J. Posta, Jr.

[57] ABSTRACT

The improvement is in an electromagnetic door lock device which is connected to the underside of the top of a door frame. An armature is attracted to the energized electromagnet and is connected to the top of the door for movement between a resting unlocked position directly on top of the door and an upwardly extending locked position adjacent the underside of the energized electromagnet. The armature which has a protrusion extending from one or both of the two opposite sides and the electromagnet carries one or a pair of tab plates connected to one or both of the opposite ends of the electromagnet and having a depending tab which intercepts the armature only when the latter is in the upwardly extended position, so as to lock the door shut. The improvement also includes a pair of depending tabs on each tab plate defining a preferably rectangular notch therebetween, which notch extends up from the bottom of the plate and is substantially wider than the preferably rectangular protrusion and is adapted to receive it to lock it in place. The two tabs of each tab plate are disposed predetermined distances from the vertical centerline of the tab plate so that the relative position of the tabs are adjustable by reversing the tab plate. The protrusions can have varying width and be removably attached to the armature. The brackets and tab plates can be integral with or without the electromagnet.

21 Claims, 2 Drawing Sheets

ELECTROMAGNETIC DOOR LOCK DEVICE

BACKGROUND OF THE INVENTION

1. Field of the Invention

The present invention generally relates to door locks and more particularly to an improvement in an electromagnetic door lock device.

2. Prior Art

There are a large number of different types of electromagnetic door locks, most of which are complicated and expensive to manufacture, install and service and many of which do not perform efficiently. One particular lock is shown in U.S. Pat. No. 4,487,439 which issued Dec. 11, 1984, to William C. McFadden and is entitled Magnetic Shear Locking Methods and Apparatus. This device utilizes a locking mechanism which operates under shear. However, this device also utilizes a specially configured electromagnet. When an armature is attracted thereto during locking, a small central tab on the housing extends into a central armature dimple to prevent the armature and the door to which it is attached from moving. Such an electromagnet housing configuration is expensive to make. Moreover, great care must be made to align the armature and housing, specifically, the the central dimple and tab, otherwise the lock will malfunction. Of more importance, considerable shear stress can occur to the housing with resultant cracking and disruption of the electromagnet, particularly if an attempt is made to force the door open while it is in the locked position. Finally, the device is not adapted to a wide variety of applications.

An improvement over the above-described locking device is set forth in U.S. Pat. No. 4,826,223, the patentee of which is the present inventor. That patent discloses a door lock device which isolates the locking tab on a separate locking tab plate releasably connected to the side of the electromagnet. If the door is forced or jammed and the tab on the tab plate is bent or broken, no damage to the housing and electromagnet occurs and the tab plate can be easily replaced. Unfortunately, the tab may bind against the armature of the device when locked and the armature may not immediately release and unlock when the electromagnet is deenergized unless the relative positions of the armature and tab are first very carefully adjusted, which takes time and some skill.

There remains a need for an improvement in such an electromagnetic door lock device which will overcome the binding and armature release problem, will permit easy adjustment of the device and which will permit the tab plate to continue to be used, even with a tab thereof bent or broken, so that replacement parts need not be immediately furnished.

SUMMARY OF THE INVENTION

The improvement of the present invention on an electromagnetic door lock device satisifies all the foregoing needs. The improvement is substantially as set forth in the Abstract of the Disclosure.

Thus, the basic device is substantially as shown in U.S. Pat. No. 4,826,223, except for the following major modifications which account for the improved results:

(a) The single tabbed tab plate of the patented device can be replaced by a double-tabbed tab on one or both of two opposite ends of the electromagnets, the two depending tabs of each tab plate defining a wide, open-bottomed, preferably rectangular notch therebetween, with the tabs spaced unequal distances from the vertical centerline of the tab plate. With this arrangement, the tab plate can be reversed to change the relative positions of the two tabs for maximum adjustability.

(b) The improvement also includes a preferably rectangular metallic protrusion extending outwardly from one or both of the two opposite sides of the armature, each protrusion being narrower than and fitting into the above-described notch. Selection of a given orientation of the tab plate will depend on the relative position of the protrusion. Moreover, if one tab becomes bent or broken due to jamming or forcing of the door, the tab plate can be reversed rather than replaced, so as to place the remaining tab in a position to intercept the armature and function as the required door lock. In addition, if a protrusion is bent, the tab plate on the affected end of the device can be reversed to provide the needed protrusion-tab clearance for proper operation of the device.

(c) In an alternative embodiment, instead of replacing the single tab plate of the patent with a double-tabbed plate, one can provide the armature of sub-paragraph (b) above with removable protrusions which are designed so as to be positioned at varying distances from the centerline of the armature to the tab. Adjustments between the armature and the tabs can accordingly be changed by changing the positioning of the projections.

(d) Another embodiment contemplates providing an armature having one or more extensions integral therewith and adapted to coact with the depending tabs. The integral extensions can be offset from the centerline of the longitudinal axis of the armature for subsequent rotation 180° or flipping upside down to provide adjustment and repositioning of the armature with the electromagnet.

(e) A still further embodiment envisions making the depending tab plate integral with the bracket and/or the electromagnet. In the latter case, the integral bracket tab plate/electromagnet could be rotated 180° with respect to the armature to provide adjustment therebetween.

DRAWINGS

DETAILED DESCRIPTION

FIGS. 1-4

Figure 1:
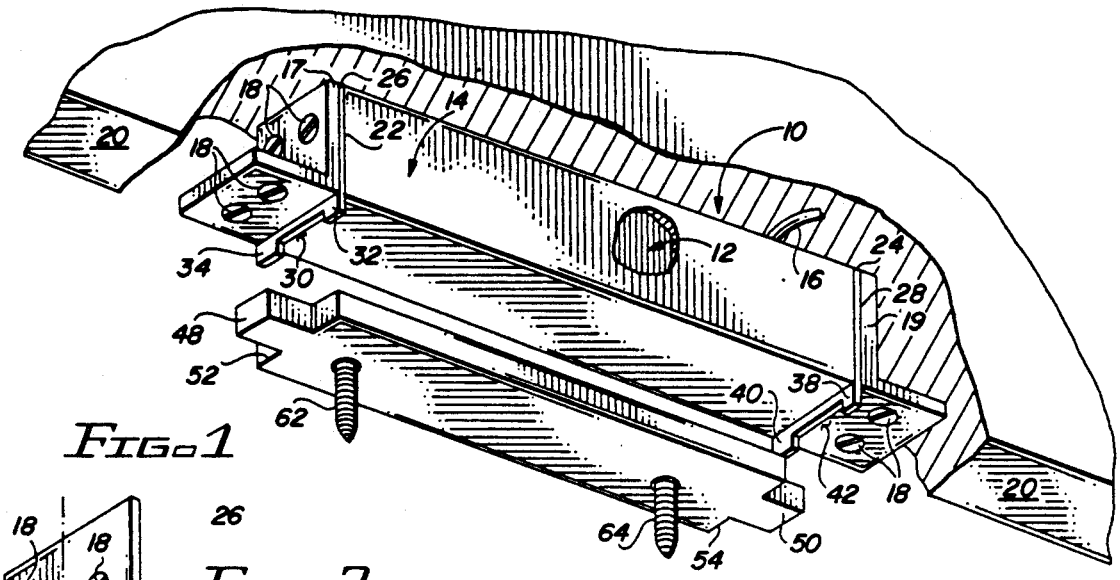
FIG. 1 is a schematic front perspective view of a preferred embodiment of the improvement in an electromagnetic door lock device.

Now referring more particularly to the accompanying drawings, a preferred embodiment of the improvement of the present invention in an electromagnetic door lock device is schematically depicted therein. Thus, device 10 is shown which comprises an electromagnet 12 disposed in a rectangular metallic housing 14 and connected to a remote power source (not shown) by an electrical conduit 16. Housing 14 is releasably connected, as by L-shaped brackets 17 and 19 and screws generally designated 18 to the underside of the top of a door frame 20. Brackets 17 and 19 are connected to opposite sides 22 and 24 of housing 14 by screws 18.

Two identical improved tab plates 26 and 28 are releasably secured to housing sides 22 and 24, respectively, by screws 18, brackets 17 and 19 being disposed on the outside thereof (FIG. 1).

Figure 3:
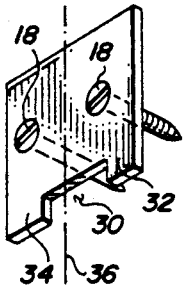
FIG. 3 is a schematic side perspective view of the improved tab plate utilized in the device of FIG. 1; and, FIG. 4 is an enlarged schematic front elevation of the tab plate of FIGS. 1 and 3.
Figure 4:
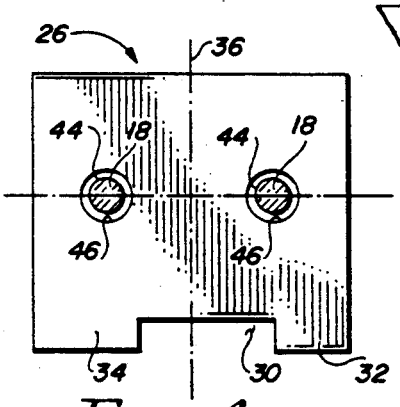

Tab plate 26 is shown in FIGS. 1, 3 and 4. It comprises a sturdy preferably flat plate of steel or the like, the bottom portion thereof bearing a preferably rectangular open-bottomed notch 30 defined by a pair of spaced tabs 32 and 34 depending below housing 14 (FIG. 1). It will be noted that tabs 32 and 34 are of unequal distances from the vertical centerline 36 (FIG. 4) of tab plate 26, tabs 32 and 34 being of unequal widths, with notch 30 being off-center relative to vertical centerline 36 but bridging centerline 36. Tab plate 28 has tabs 38 and 40 identical to tabs 32 and 34, respectively, and notch 42 is identical to notch 30.

It will be noted that the shanks 44 of the two screws 18 which pass through openings 46 in tab plate 26 are equidistant from vertical centerline 36 and level with each other so that tab plate 26 can be reversed on side 22 to provide a reverse orientation of tabs 32 and 34, for reasons set forth hereinafter. Tab plate 28 can be similarly reversed, if needed, due to the same screw 18 orientation as described for tab plate 26.

The present improvement includes preferably rectangular protrusions 48 and 50 from opposite sides 52 and 54 of elongated armature 56, fabricated of metal magnetically attracted to electromagnet 12. It will be understood that, if desired, a single protrusion 48 with a single tab plate 26 could be used in device 10. Protrusions 48 and 50 are narrower in width than notches 30 and 42 and adapted to fit easily therein. Sides 52 and 54 lie medial of tab plates 26 and 28 when armature 56 is attracted to electromagnet 12; that is, when the latter is energized by electrical current passing through conduit 16.

Figure 2:
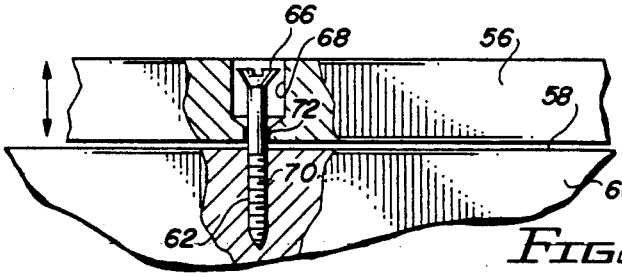
FIG. 2 is an enlarged schematic front elevation, partly broken away, of the armature of FIG. 1 and a door top to which the armature is connected.

In this regard, as shown in FIG. 2, armature 56 in the resting position, with electromagnet 12 deenergized, lies directly on the top surface 58 of door 60 hinged in door frame 20. It is connected thereto by a spaced pair of screws 62 and 64, the heads 66 of which are disposed in large open-topped narrow bottomed pockets 68 in armature 56, while the shanks 70 thereof pass down therethrough, passing down out of armature 56 and are threaded into and rigidly held in door 60 near top surface 58.

With this arrangement, when door 60 is positioned closed and directly under housing 14 and electromagnet 12 is energized, armature 56 is magnetically attracted directly upwardly toward housing 14, its upward position being limited by heads 66 striking narrow bottoms 72 of pockets 68. When so attracted, protrusions 48 and 50 fit up into notches 30 and 42, respectively. In this position, door 60 is locked closed; that is, protrusions 48 and 50 will abut tabs 32 and 38 or tabs 34 and 40 if one tries to open door 60. Door 60 cannot therefore be opened, until electromagnet 12 is deenergized and armature 56 falls by gravity to top surface 58 of door 60, so that protrusions 48 and 50 clear below notches 30 and 42 and their respective tabs. If armature 56 is improperly aligned on top surface 58 so that protrusions 48 and 50 wedge or rub against any adjoining tab surfaces, tab plates 26 and 28 can be removed easily and reversed, on each side of housing 14, providing better protrusion clearance.

If one of the tabs of either plate 26 or 28 or either protrusion 48 or 50 becomes bent or damaged, for example, due to jamming as a result of improper armature-housing alignment or due to having someone try to force or pry door 60 open when it is locked, the now misaligned tab plates 26 and/or 28 can be reversed or interchanged on housing 14 so as to place the proper tab in a position to clear the respective protrusion but block the respective protrusion when someone tries to open door 60, thereby functioning as the required door lock.

Accordingly, the double tabbed array of the improved tab plate configuration provides a spare locking tab and means of correcting bent armature protrusions. Moreover, the eccentric tab alignment in each plate allows each tab plate to be reversed to provide the desired tab-protrusion clearance for easy functioning in any event, whether or not bending is included. For the purpose of the present invention, it is preferred that the protrusions 48 and 50 be centered along the width of armature 56, while notches 30 and 42 bridge the bottom centerline of tab plates 26 and 28 and extend for unequal distances on either side of that centerline. Plates 26 and 28 with their notches and tabs and armature 56 with its protrusions 48 and 50 are simple and easy to provide in various sizes and shapes to meet specific circumstances.

Figure 6:
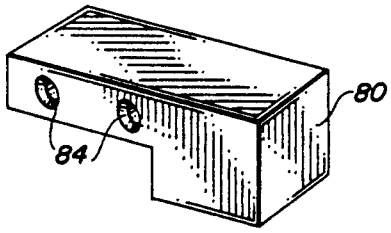
FIG. 6 is an enlarged schematic front elevation of an armature extension member.
Figure 5:
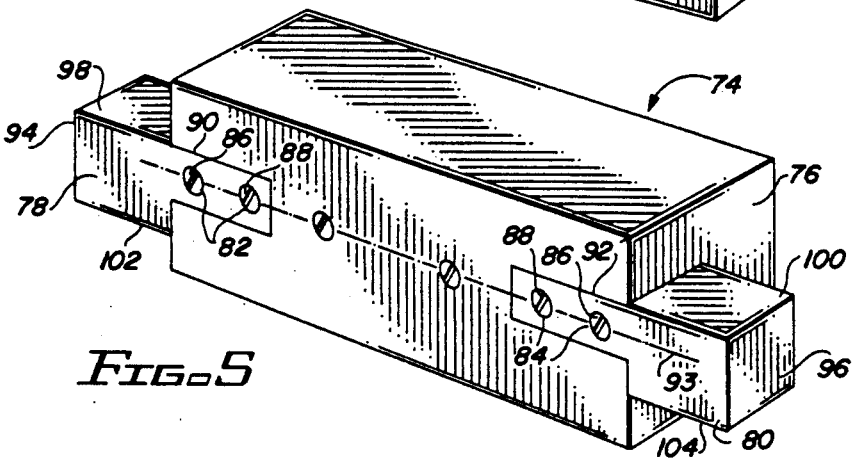
FIG. 5 is a front perspective view of an alternate embodiment of the invention utilizing a segmented armature.
Figure 7:
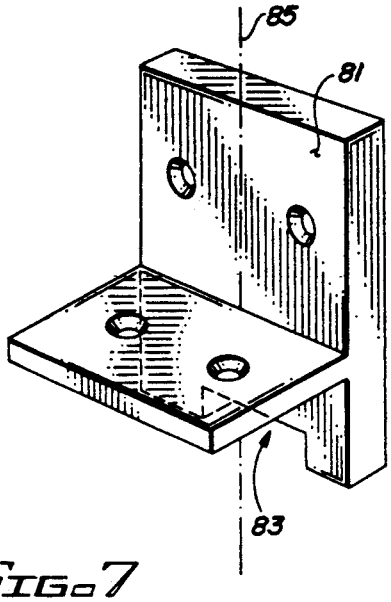
FIG. 7 is a perspective view of an integral tab plate and securing bracket.
Figure 8:
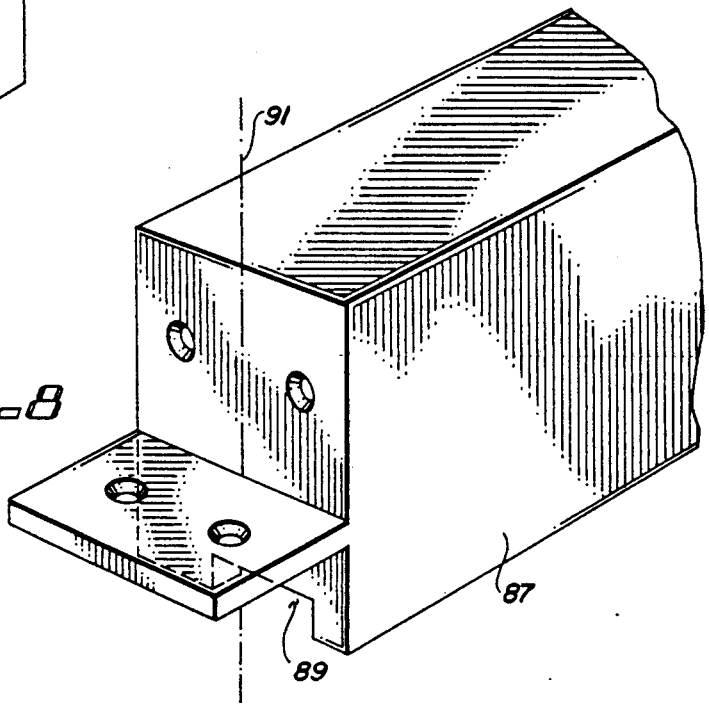
FIG. 8 is a perspective view of an integral tab plate, bracket and electromagnet.
Figure 9:
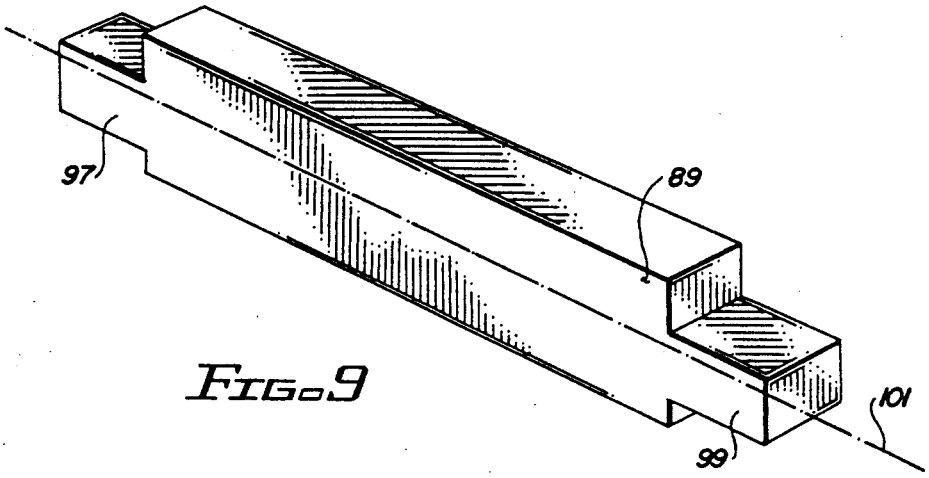
FIG. 9 is a perspective view of an armature having integral extensions which are off-set from the armature longitudinally extending central axis.

FIGS. 5 and 6

An alternate method and apparatus for achieving the same result obtainable by the assembly of FIGS. 1-4 is shown in FIGS. 5 and 6. The armature 56 shown in FIGS. 1-4 have integral protrusions 48 and 50. In the embodiment of FIGS. 5 and 6, this is replaced by an armature 74 which is constructed of three pieces, i.e., armature base 76 and removable extensions 78 and 80. Each extension 78 and 80 have mounting openings 82 and 84 adapted to receive mounting screws 86 and 88.

Extensions 78 and 80 are mounted within channels 90 and 92, which channels are positioned along the centerline 93 of armature 76 such that the top and bottom of channels 90 and 92 are equidistant from centerline 93.

The outermost ends 94 and 96 of extensions 78 and 80 have their respective top sides 98 and 100 and bottom sides 102 and 104 being at unequal distances from centerline 93.

As is the case with protrusions 48 and 50 of armature 56, extensions 78 and 80 are adapted to be received within notches 30 and 42 in tab plates 26 and 28 respectively. However, when misalignment occurs, an adjudgment can be provided by removing one or both extensions 78 and 80, rotating them 180°, and replacing them in channels 90 and 92, so as to provide the desired realignment desired.

If desired, a set of extensions 78 and 80 could be provided, each of which have different widths projecting from the ends of armature 76. When a specific adjustment is required, the specific extension from the set would be utilized to correct the misalignment.

FIG. 7

It is contemplated that the separate tab plate 26 and bracket 17 of FIG. 1 could readily be replaced by a single combination tab plate/bracket member 81. Notch 83 is displaced from the vertical centerline 85 of member 81, in the same manner as shown with respect to tab plate 26 in FIG. 4. Making member 81 as an integral unit results in obvious manufacturing and assembly cost savings.

FIG. 8

It is also contemplated that the separate tab plate 26, bracket 17 and electromagnet 12 (with or without housing 14) can be combined into a single unit 87, which has notch 89 displaced from vertical centerline 91. Making unit 87 as an integral unit results in obvious manufacturing and assembly cost savings. Further, unit 87 can be rotrated 180° with respect to an armature to effect relative positioning and adjustment therebetween.

FIG. 9

In this figure, armature 89 is shown having extensions 97 and 99 integral therewith, but each of which is offset from centerline 101. Armature 89 is similar in structure and operation to armature 74 except that in the former, extensions 97 and 99 are integral with the armature, while extensions 93 and 94 of armature 74 are separate from and removably secured to armature 74. Armature 89 can be rotated 180° or flipped upside down to reposition and adjust its locking position with tabs carried by electromagnet 12 or 87.

What is claimed is:

1. In an electromagnetic door lock device having an electromagnet in a housing connected to the underside of the top of a door frame, an armature attracted to the electromagnet only when the latter is energized, the armature being connected to the top of a door hinged in the door frame and movable between a resting unlocked position directly on the top of the door and an upwardly extended locked position adjacent to the underside of the housing when the electromagnet is energized, and locking means including one or a pair of tab plates connected to one or both opposite sides of the housing, each said tab plate having a depending tab adapted to intercept the armature only when the latter is in the upwardly extended position, the improvement which comprises a tab plate having a spaced pair of depending tabs defining a notch therebetween extending upwardly from the bottom thereof, said tabs being disposed unequal distances from the vertical centerline of said plate, and an armature having a protrusion extending outwardly from at least one of the two opposite sides thereof and receivable within said notch only when said armature is in said locked upwardly extended position so as to prevent said door from opening.

2. The improvement of claim 1 wherein each said tab plate, housing and armature is metallic.

3. The improvement of claim 1 wherein said tab plate is releasably secured by securing means to said side of said housing, said securing means being positioned so that said tab plate is reversible.

4. The improvement of claim 3 wherein said securing means are a pair of openings in each of said tab plate and adjoining housing side disposed equal distances from said vertical centerline of said tab plate, said distances being the same in said tab plate and said housing side, and screw means receivable through said openings into said housing side.

5. The improvement of claim 1 wherein said notch is rectangular, as is said armature protrusions, the width of said notch being larger than that of said armature protrusions.

6. The improvement of claim 1 wherein each said protrusion extends along the longitudinal centerline of said armature.

7. In an electromagnetic door lock device having an electromagnet adapted to attract an armature, an armature attracted to the electromagnet only when the latter is energized, the armature being connected to the top of a door hinged in the door frame and movable between a resting unlocked postion directly on the top of the door and an upwardly extended locked position adjacent to the underside of the electromagnet when the electromagnet is energized, and locking means including one or a pair of tab plates connected to one or both opposite sides of the electromagnet, each said tab plate having a depending tab adapted to intercept the armature only when the latter is in the upwardly extended position, the improvement which comprises a tab plate having a spaced pair of depending tabs defining a notch therebetween extending upwardly from the bottom thereof, said tabs being disposed unequal distances from the vertical centerline of said plate, and an armature having a protrusion extending outwardly from at least one of the two opposite sides thereof and receivable within said notch only when said armature is in said locked upwardly extended position so as to prevent said door from opening.

8. The improvement in claim 7 wherein each of the tab plate and armature are metallic.

9. The improvement of claim 7 wherein said tab plate is releasably secured by securing means to said side of said electromagnet, said securing means being positioned so that said tab plate is reversible.

10. The improvement of claim 9 wherein said securing means are a pair of openings in each of said tab plate and adjoining electromagnet disposed equal distances from said vertical centerline of said tab plate, said distances being the same in said tab plate and said electromagnet, and screw means receivable through said openings into said electromagnet.

11. The improvement of claim 7 wherein said notch is rectangular, as is said armature protrusions, the width of said notch being larger than that of said armature protrusions.

12. The improvement of claim 7 wherein each said protrusion extends along the longitudinal centerline of said armature.

13. The improvement of claim 1 wherein said protrusion is integral with said armature.

14. The improvement of claim 1 wherein said protrusion is an extension which is removably secured to said armature.

15. The improvement of claim 14 wherein said protrusion has mounting means disposed along the longitudinal centerline of said armature.

16. The improvement of claim 14 wherein the width of said armature varies along its length.

17. The improvement of claim 14 wherein the top and bottom of said protrusions lie at unequal distances from the longitudinal centerline of said armature.

18. The improvement of claim 7, wherein each said tab plate includes a bracket portion integral therewith for securing the tab plate to the door frame.

19. The improvement of claim 16 wherein said tab plate is formed integrally with said electromagnet.

20. The improvement of claim 13 wherein the width of said protrusion varies along its length.

21. The improvement of claim 18 wherein the protrusions have a top and bottom which lie at unequal distances from the longitudinal centerline of said armature.

* * * * *